US006907942B2

(12) United States Patent
Kikuchi et al.

(10) Patent No.: US 6,907,942 B2
(45) Date of Patent: Jun. 21, 2005

(54) PERCUSSION TOOL

(75) Inventors: Atsuyuki Kikuchi, Ibaraki (JP); Masato Sakai, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 10/354,140

(22) Filed: Jan. 30, 2003

(65) Prior Publication Data

US 2003/0155142 A1 Aug. 21, 2003

(30) Foreign Application Priority Data

Feb. 19, 2002 (JP) ..... P2002-041716

(51) Int. Cl.[7] ..... B25D 17/00

(52) U.S. Cl. ..... 173/114; 173/109; 173/117; 173/201

(58) Field of Search ..... 173/14, 109, 114, 173/117, 201, 217; 310/47, 50

(56) References Cited

U.S. PATENT DOCUMENTS 2,348,895 A * 5/1944 Gaudio ..... 30/228
3,161,242 A * 12/1964 Etzkorn et al. ..... 173/109
3,876,014 A * 4/1975 Moores, Jr. ..... 173/47
4,290,492 A * 9/1981 Sides et al. ..... 173/118
4,582,144 A * 4/1986 Mizutani ..... 173/14
4,766,963 A * 8/1988 Hartwig et al. ..... 173/109

* cited by examiner

*Primary Examiner*—Stephen F. Gerrity
*Assistant Examiner*—Nathaniel Chukwurah
(74) *Attorney, Agent, or Firm*—McGinn & Gibb, PLLC

(57) ABSTRACT

In a percussion tool such as an electric hammer or a hammer drill in which the axial direction of a motor 8 is substantially perpendicular to that of a tool bit 1 attached to a tool holder 2, a motor housing 3 is made of a hard material such as aluminum, and a tail cover 4 is disposed on the lower end of the motor housing 3, projections 3*a* and 3*b* which project beyond the tail cover 4 are disposed.

21 Claims, 6 Drawing Sheets

PERCUSSION TOOL

BACKGROUND OF THE INVENTION

1. Field of the Invention

The present invention relates to a percussion tool such as an electric hammer or a hammer drill in which the axial direction of a motor is substantially perpendicular to that of a tool bit held by a tool holder, a motor housing is made of a hard material such as aluminum, and a tail cover is attached to the lower end of the motor housing.

2. Description of the Related Art

Conventionally, in an electric hammer or a hammer drill in which a motor is placed so that the axial direction of the motor is substantially perpendicular to that of a tool bit held by a tool holder, a motor housing is made of a hard material such as aluminum, and a tail cover is attached to the lower end of the motor housing, the tail cover is usually configured by a resin-made member for the purposes of, for example, reduction in weight and cost.

A motor housing has functions of supporting the shaft of a motor housed therein, and holding brushes which are to be in contact with a commutator of the motor, and is configured so that an opening is formed in a lower end side in order to improve the assembling property of the motor or the like. The opening is closed by a detachable tail cover.

In some of conventional electric hammers and hammer drills, a motor housing is formed by a molded product. In this configuration, however, the strength of the motor housing is so low that the motor housing is damaged or broken during a work. Therefore, a motor housing is formed by a molded product of a hard material such as aluminum in order to enhance the strength of the motor housing.

In a conventional percussion tool such as a above-described one, since a tail cover attached to a bottom face of a motor housing is formed by a resin-made member, the tail cover is often in contact with a work member, the ground, or the like during a work to be heavily damaged or worn. In some cases, the tail cover may be broken.

Particularly, a lower end portion of such a tail cover on the side of a tool bit is in contact with a work member, the ground, or the like with a higher probability to be damaged or worn.

When a chipping or crushing work is conducted in the state where a tail cover which is formed by a resin-made member as described above is in contact with a work member, the ground, or the like, the contacting portion of the tail cover is easily damaged, worn, or broken because the body of the percussion tool is vibrated in the axial direction of a tool bit by repercussion due to the percussive movement of the tool bit.

When the percussion tool body is dropped on the ground or the like, the tail cover collides against the ground or the like, whereby the resin-made tail cover is often broken.

In order to solve the problems discussed above, a tail cover which is formed by a pressed metal product in place of a molded product of low strength and wear resistance may be contemplated. In this case, reduction in weight and cost cannot be attained, the tail cover is hardly formed into a complex shape, and the shape of the motor housing and the like are restricted. Namely, there arises a further problem in that the degree of freedom in design of the tool body is reduced.

SUMMARY OF THE INVENTION

In order to solve the above problems with the conventional art, an object of the invention is to provide a percussion tool which can overcome these defects, and in which a resin-made tail cover is employed to attain reduction in weight and cost, and the tail cover is prevented from being damaged, worn, or broken.

The object can be accomplished by disposing a projection which projects beyond a tail cover, on a motor housing.

Furthermore, the object can be accomplished by disposing a rib which is positioned between a tool holder and the tail cover, and which downward projects beyond a tangential line between a lower end portion of the tool holder and a lower end portion of the tail cover on a side of the tool holder.

Moreover, the object can be accomplished by disposing a downward projection which is disposed on the lower end of the motor housing, and which downward projects beyond the tail cover through a hole formed in the tail cover.

DETAILED DESCRIPTION OF THE PREFERRED EMBODIMENTS

Figure 1:
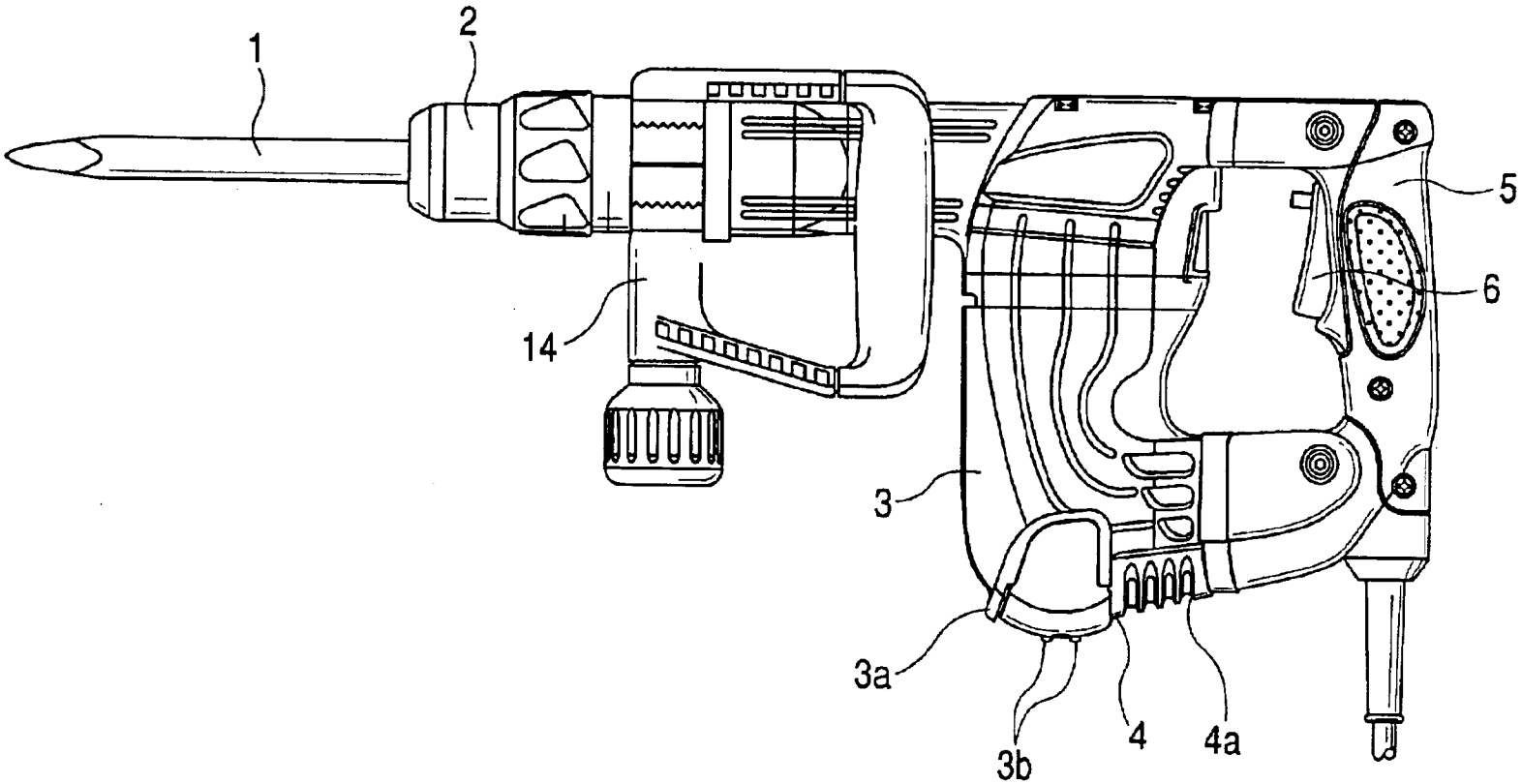
FIG. 1 is a front view showing an embodiment of the percussion tool of the invention.
Figure 2:
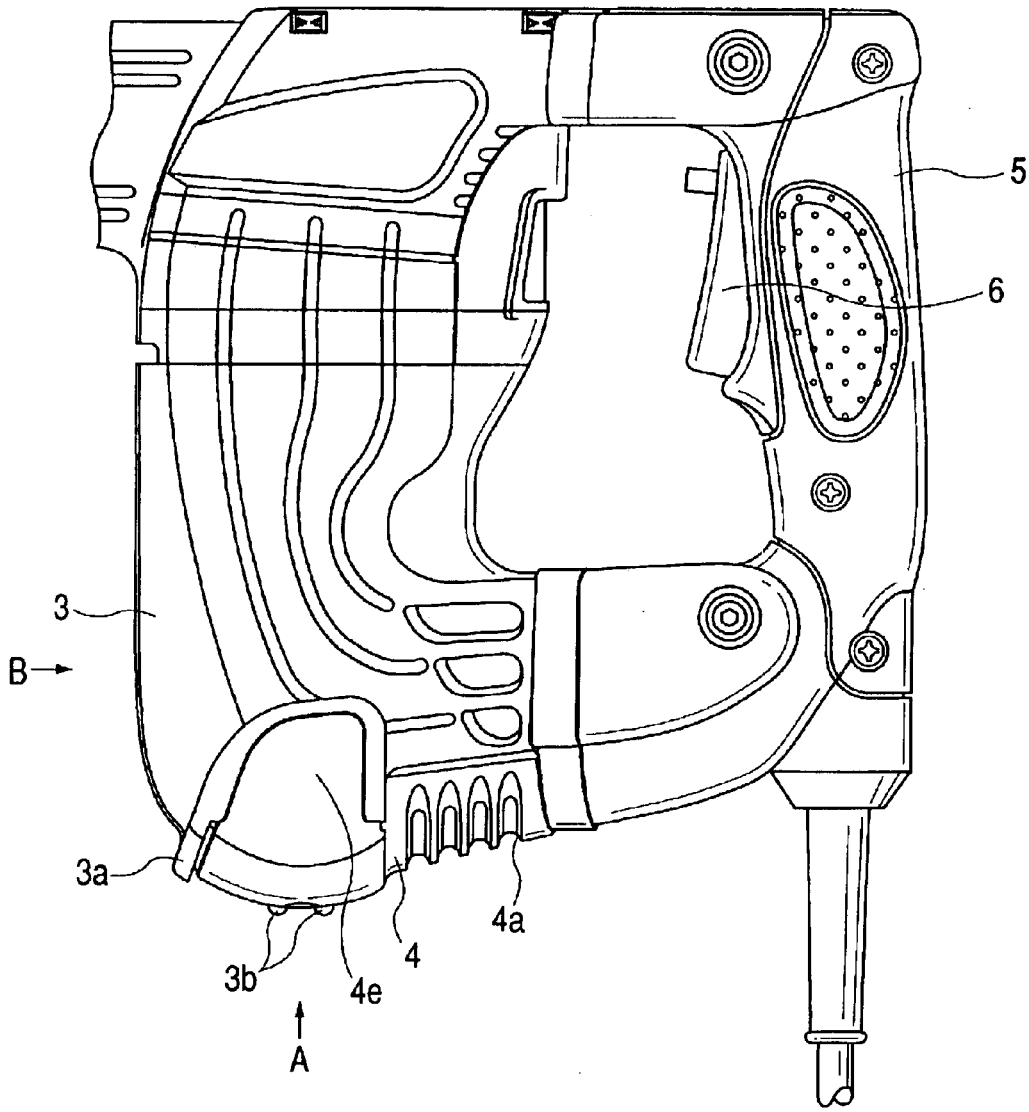
FIG. 2 is an enlarged view of main portions of FIG. 1.
Figure 3:
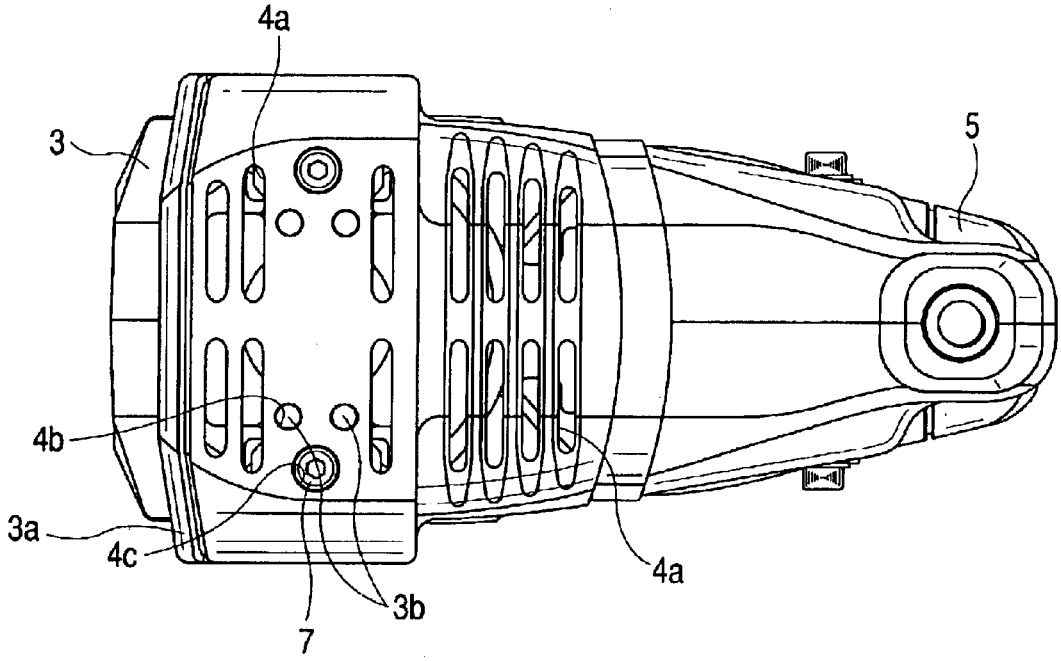
FIG. 3 is a view looking in the direction of the arrow A in FIG. 2.
Figure 4:
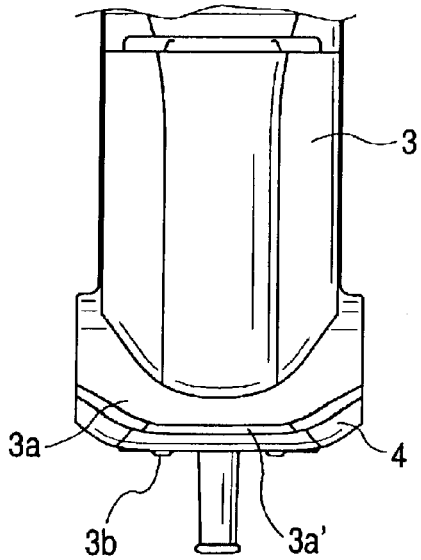
FIG. 4 is a view looking in the direction of the arrow B in FIG. 2.
Figure 5:
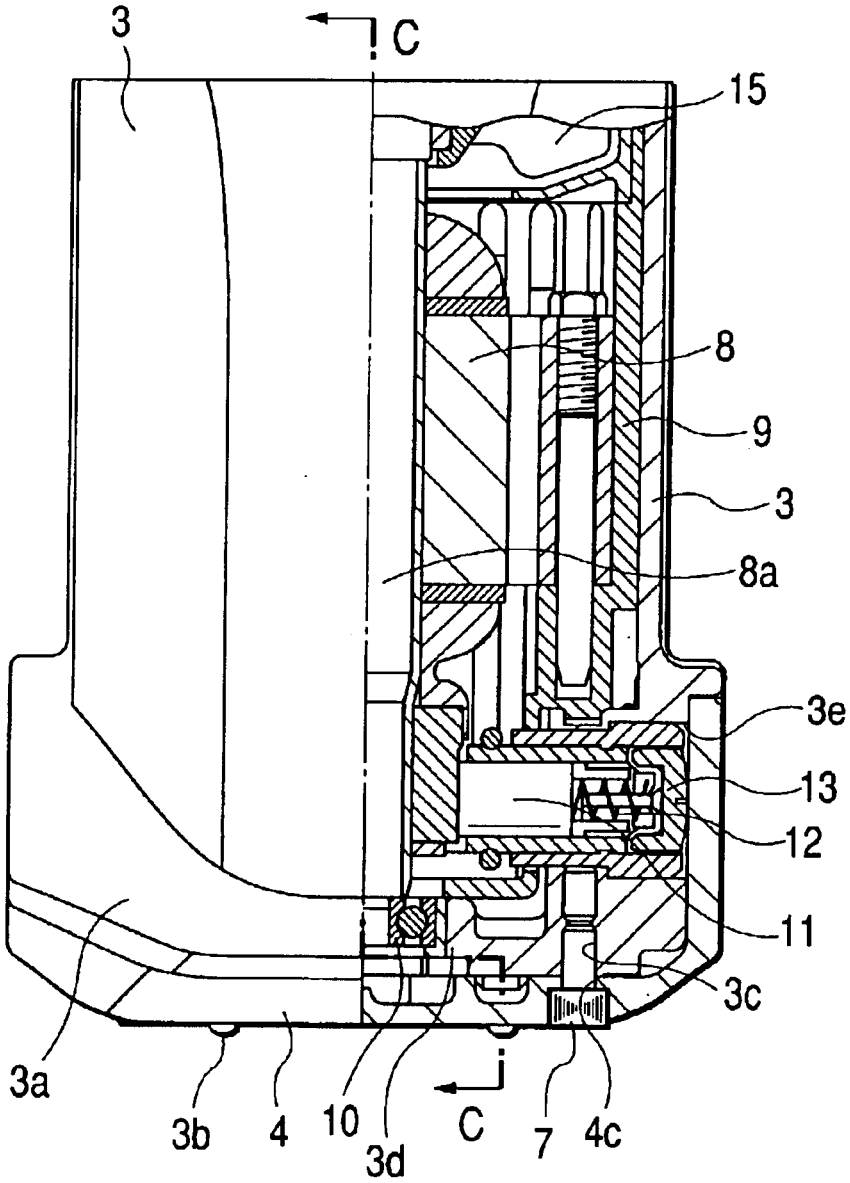
FIG. 5 is a section view of main portions of FIG. 4.
Figure 6:
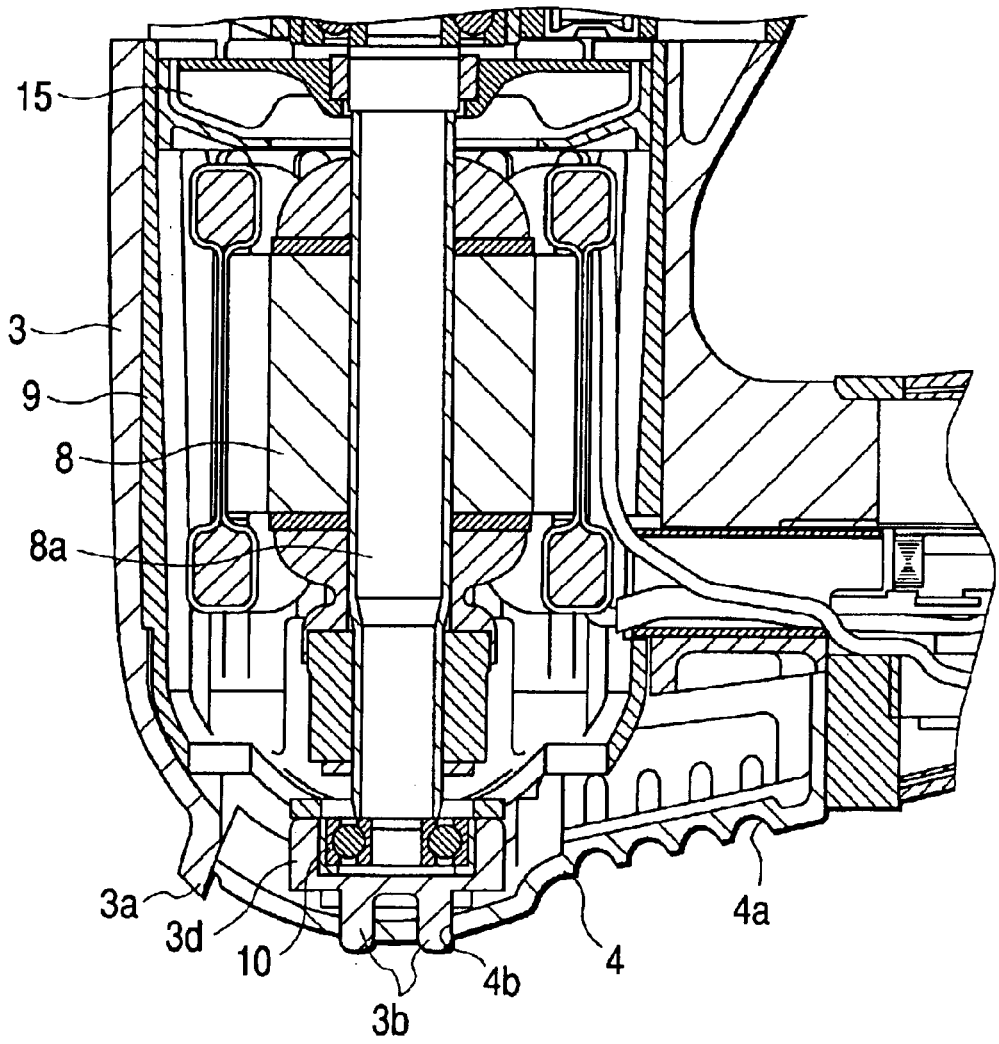
FIG. 6 is a section view taken along the line C—C of FIG. 5.
Figure 7:
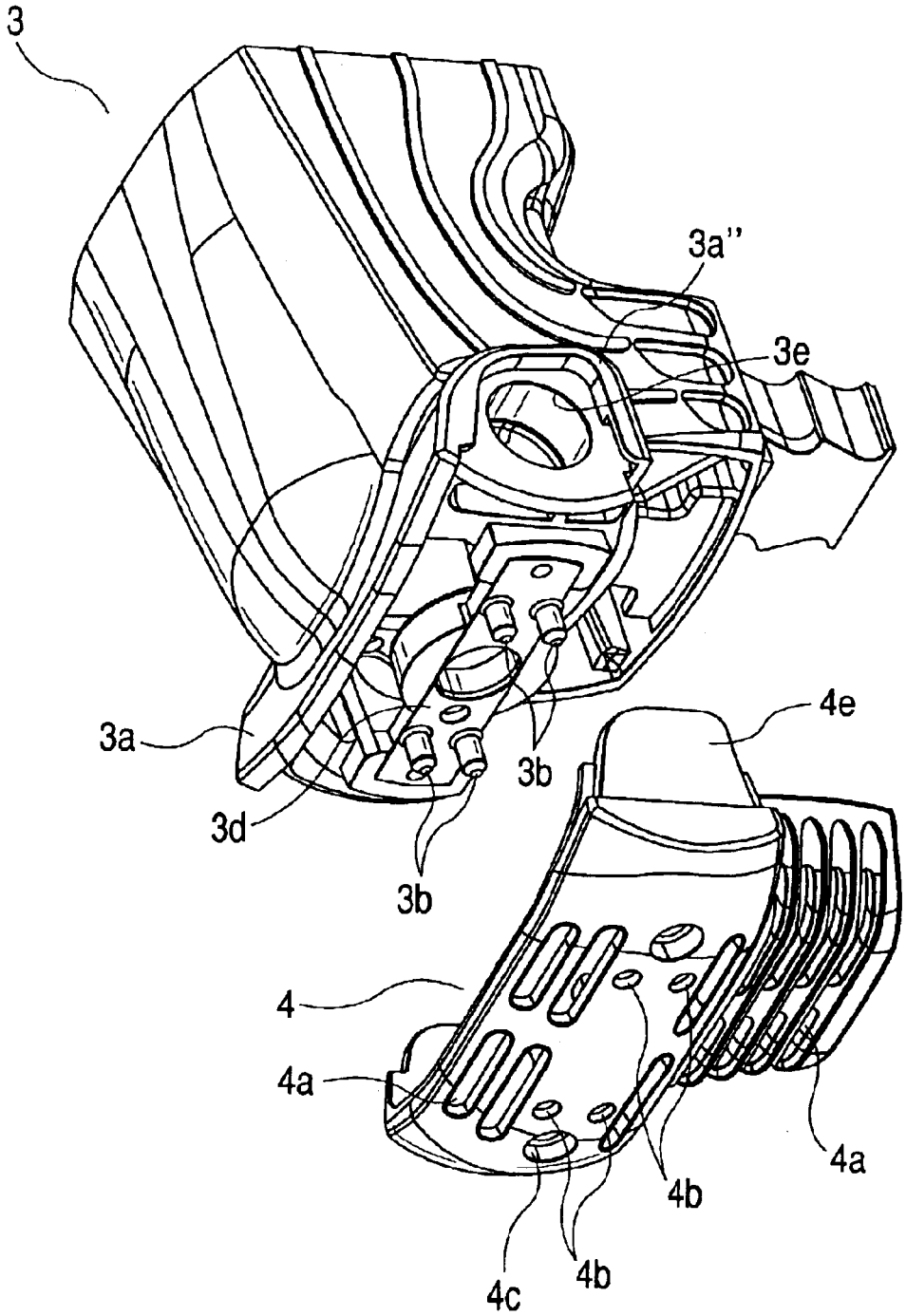
FIG. 7 is a development view showing an embodiment of a motor housing and a tail cover which constitute the percussion tool of the invention.

Hereinafter, an embodiment of the percussion tool of the invention will be described with reference to FIGS. 1 to 7. FIG. 1 is a front view of a percussion tool to which a tool bit 1 is attached, FIG. 2 is an enlarged view of main portions of FIG. 1, FIG. 3 is an enlarged view looking in the direction of the arrow A in FIG. 2, FIG. 4 is an enlarged view looking in the direction of the arrow B in FIG. 2, FIG. 5 is a section view of main portions of FIG. 4, FIG. 6 is a section view taken along the line C—C of FIG. 5, and FIG. 7 is a development view showing an embodiment of a motor housing and a tail cover which constitute the percussion tool of the invention. FIG. 1 shows a state in which a detachable sub-handle 14 is attached to the percussion tool.

As shown in the figures, the percussion tool has: a tool holder 2 which holds the tool bit 1 so as to be axially movable; a motor housing 3 in which a motor 8 is incorporated; and a handle 5 having a switch 6 which controls the driving of the motor 8. The percussion tool is structured so that, when the motor 8 is rotated by an internal structure which is not shown, the tool bit 1 held by the tool holder 2 is reciprocally moved in the axial direction and a work member is struck by the tool bit 1.

The tool bit 1 attached to the tool holder 2, and the motor 8 are placed so that their axial directions are substantially perpendicular to each other, and the handle 5 is placed so as to elongate substantially parallel to the axial direction of the motor 8.

The motor housing 3 is formed by a member made of aluminum, and has a configuration in which the motor 8 is housed via a motor housing 9 made of a resin. A bearing bracket 3*d* for receiving a bearing 10 which rotatably supports the shaft 8*a* of the motor 8 is disposed in a lower end portion of the motor housing 3. The lower end portion of the motor housing 3 is shaped so as to be opened except the bearing bracket 3*d*. The shape of the lower end portion of the motor housing 3 in which a predetermined area is opened facilitates the work of assembling the motor 8 in the motor housing 3, and allows cooling air to flow into the motor housing 3 through the lower end portion when a cooling fan 15 housed in the motor housing 3 is rotated by rotation of the motor 8.

A tail cover 4 which is made of a resin, and which is shaped so as to cover the lower end portion of the motor housing 3 is attached to the lower end of the motor housing 3 by two bolts 7. A plurality of air holes 4*a* are opened in the tail cover 4. The cooling air which is generated during rotation of the cooling fan 15 flows into the motor housing 3 through the opening in the lower end of the motor housing 3.

When the motor 8 is rotated, a percussion transmission mechanism which is not shown operates to repeatedly strike an end portion of the tool bit 1 which is held in the tool holder 2 so as to be movable by a predetermined distance in the axial direction, thereby causing the tool bit 1 to reciprocally move in the axial direction.

Several kinds of tool bits having different axial dimensions can be used as the tool bit 1 which is to be attached to the percussion tool. Usually, tool bits having axial dimensions of about 28 cm and about 40 cm are often used. The tool bit 1 shown in FIG. 1 has an axial dimension of about 28 cm.

As shown in FIG. 1, in the percussion tool of the invention, a rib 3*a* which is integrated with the motor housing 3, and which obliquely downward projects is disposed on the lower end portion of the motor housing 3 on the side of the tool holder 2. The rib 3*a* is positioned between the tool holder 2 and the tail cover 4, and shaped so as to cover an upper side portion of the tail cover 4. As shown in FIG. 1, the rib 3*a* has a shape which downward projects beyond a tangential line connecting the lower end portion of the tool holder 2 with that of the tail cover 4. According to the configuration, even when, during a work conducted in the vicinity of a work member, the ground, or the like, the lower end portion of the motor housing 3 is in contact with the work member, the ground, or the like, the tail cover 4 can be prevented from being in contact with the work member or the like. During such a work, the rib 3*a* of the motor housing 3 may be in contact with a work member, the ground, or the like, but the product life period is not shortened because the rib 3*a* is formed integrally with the motor housing 3 and made of a hard material such as aluminum.

In the embodiment, the rib 3*a* is formed so as to downward project beyond a tangential line connecting the front end portion of the tool bit 1 with the lower end portion of the tail cover 4 on the side of the tool holder 2, in the state where the tool bit 1 having an axial dimension of about 28 cm or about 40 cm which is often used is attached to the tool, whereby the tail cover 4 is prevented from being in contact with a work member, the ground, or the like during a work.

As shown in FIG. 4, when looking from the side of the tool bit 1, the above-mentioned rib 3*a* has a shape including a linear portion 3*a*' which elongates so as to be perpendicular to the axial direction of the motor 8. According to the configuration, when the percussion tool is placed on the ground or a floor, the lower end of the tool holder 2 and the linear portion 3*a*' of the rib 3*a* are in contact with the ground or the floor in the state where the tool bit 1 is not attached to the tool, and the front end portion of the tool bit 1 and the linear portion 3*a*' of the rib 3*a* are in contact with the ground or the floor in the state where the tool bit 1 is attached to the tool, with the result that the percussion tool is stably placed. In this state, the percussion tool is placed while the handle 5 stands upright with respect to the face such as the ground or the floor. Therefore, the handle 5 can be easily grasped for the next work. Namely, the percussion tool body can be easily grasped and the workability can be improved. In place of the linear portion 3*a*', two or more projecting ribs 3*a* may be disposed so that the percussion tool is placed on the ground or the floor by means of a three-point support including the lower end of the tool holder 2 or the front end of the tool bit 1.

As shown in FIG. 4, the rib 3*a* has right and left projections 3*a*" which project from the motor housing 3 in the rightward and leftward directions in the figure, and which are positioned above the tail cover 4. Each of the right and left projections 3*a*" has a shape which projects from the tail cover 4 in the rightward or leftward direction in the figure, whereby the tail cover 4 is prevented from being in contact with an external member in the direction.

As shown in FIG. 7, each of the right and left projections 3*a*" has a shape which covers the upper side of respective one of brush holding holes 3*e* formed in the motor housing 3. As shown in FIG. 5, a brush 11 which is always urged toward the shaft 8*a* of the motor 8 by a spring 12, and a brush cap 13 which holds the brush 11 so as to prevent the brush 11 from projecting to the outside are attached into each of the brush holding holes 3*e*. In the tail cover 4, brush pressers 4*e* which respectively press the brush caps 13 to surely prevent the brush 11 from projecting to the outside are disposed on the inner wall. Engagement portions which are to be engaged with the brush pressers 4*e* of the tail cover 4 are disposed on the right and left projections 3*a*" of the rib 3*a*, respectively to surely restrict the position of the tail cover 4.

As shown in FIG. 7, a plural number (four) of downward projections 3*b* which downward project are disposed on the bearing bracket 3*d* in the vicinity of the bearing 10 in the lower end portion of the motor housing 3.

As shown in FIGS. 1 to 7, particularly, in FIG. 6, the downward projections 3*b* pass through the tail cover 4 to project into the side lower than the tail cover 4. A plural number (four) of holes 4*b* which respectively correspond to the downward projections 3*b* are formed in the tail cover 4 as shown in FIG. 7. The downward projections 3*b* project downward beyond the tail cover 4 through the holes 4*b*, respectively.

According to the configuration, even when, during a work conducted in the vicinity of a work member, the ground, or the like, the downward projections 3*b* on the lower end portion of the motor housing 3 is in contact with the work member, the ground, or the like, the tail cover 4 can be prevented from being in contact with the work member or the like. When the percussion tool in the state shown in FIG. 1 is dropped on a member such as the ground or a floor, the downward projections 3*b* made of a hard material collide with the ground or the floor, whereby the resin-made tail cover 4 can be prevented from colliding with the ground or the floor and receiving a high impact to be broken. In the embodiment, the downward projections 3*b* are formed integrally with the motor housing 3. Alternatively, the downward projections may be formed by members which are placed between the tail cover 4 and the motor housing 3, and which are separate from the motor housing 3, as far as the downward projections downward protrude beyond the tail cover 4 and are formed by members which are harder than the tail cover 4.

The protrusion distances of the rib 3*a* and the downward projections 3*b* are designed so as not to allow the tail cover 4 to project beyond a tangential line between the lower end portion of the rib 3*a* and the lower end portion of the front one of the downward projections 3*b*.

As described above, according to the invention, the projections 3*a* and 3*b* which protect the tail cover 4, i.e., which prevent the tail cover 4 from being in contact with the ground, a floor, or the like, and which project beyond the tail cover 4 are disposed. Therefore, the tail cover 4 which is made of a resin can be prevented from being damaged, worn, or broken, and the product life period can be prolonged.

Since the life period of the tail cover 4 can be prolonged, the tail cover 4 can be formed by a resin-made member. Therefore, reduction in weight and cost can be attained. Furthermore, the tail cover 4 can be formed into a relatively complex shape, so that the degree of freedom in design of the tool body can be enhanced.

According to the invention, a projection which projects beyond a tail cover is disposed on a motor housing, and hence it is possible to provide a percussion tool in which a resin-made tail cover can be employed to attain reduction in weight and cost, and the tail cover can be prevented from being damaged, worn, or broken.

What is claimed is:

1. A percussion tool comprising:

a motor;

a tool holder which detachably holds a tool bit;

a member which converts a turning force of said motor into a reciprocating force, and transmits the reciprocating force to said tool bit, in which an axial direction of said motor is substantially perpendicular to an axial direction of said tool bit which is held by said tool holder;

a motor housing which covers said motor, comprising a hard material; and a tail cover attached to a lower end of said motor housing, wherein a projection which projects beyond said tail cover, is integrally-formed with said motor housing, and wherein said projection, comprises a rib between said tool holder and said tail cover, and which downwardly projects beyond a tangential line between a lower end portion of said tool holder and a lower end portion of said tail cover on a side of said tool holder.

2. The percussion tool according to claim 1, wherein said projection comprises a downward projection on said lower end of said motor housing, and which downwardly projects beyond said tail cover through a hole formed in said tail cover.

3. The percussion tool according to claim 2, wherein said downward projection and said hole are disposed in plural.

4. The tool of claim 1, wherein said tail cover comprises a resin material.

5. A percussion tool comprising:

a motor;

a tool holder which detachably holds a tool bit;

a member which converts a turning force of said motor into a reciprocating force, and transmits the reciprocating force to said tool bit, in which an axial direction of said motor is substantially perpendicular to an axial direction of said tool bit which is held by said tool holder;

a motor housing which covers said motor, comprising a hard material; and a tail cover attached to a lower end of said motor housing, wherein a projection, which projects beyond said tail cover, is integrally-formed with said motor housing, wherein said projection comprises:

a rib between said tool holder and said tail cover, and which downwardly projects beyond a tangential line between a lower end portion of said tool holder and a lower end portion of said tail cover on a side of said tool bit; and a downward projection on said lower end of said motor housing, and which downwardly projects beyond said tail cover through a hole in said tail cover, and wherein said tail cover does not protrude beyond a tangential line between a lower end of said rib and a lower end of said downward projection.

6. A percussion tool comprising:

a motor;

a tool holder which detachably holds a tool bit;

a member which converts a turning force of said motor into a reciprocating force, and transmits the reciprocating force to said tool bit, in which an axial direction of said motor is substantially perpendicular to an axial direction of said tool bit which is held by said tool holder;

a motor housing which covers said motor, comprising a hard material; and a tail cover attached to a lower end of said motor housing, wherein a projection, which projects beyond said tail cover, is integrally-formed with said motor housing, and wherein said projection comprises a rib between said tool holder and said tail cover.

7. The tool of claim 6, wherein said projection projects beyond a tangential line between a lower end portion of said tool holder and a lower end portion of said tail cover on a side of said tool holder.

8. The tool of claim 6, wherein said projection comprises a downward projection on a lower end of said motor housing.

9. The tool of claim 8, wherein said downward projection projects beyond said tail cover through a hole formed in said tail cover.

10. The tool of claim 9, wherein said tail cover does not protrude beyond a tangential line between a lower end of said rib and a lower end of said downward projection.

11. A percussion tool comprising:

a motor;

a tool holder detachably holding a tool bit;

a member that converts a turning force of said motor into a reciprocating force, and transmits the reciprocating force to said tool bit;

a motor housing comprising a hard material that covers said motor; and a tail cover attached to a lower end of said motor housing, wherein a projection projects from said motor housing beyond a tangential line between a lower end portion of the tool holder and a lower end portion of the tail cover on a side of the tool holder.

12. The tool of claim 11, wherein said projection comprises a rib.

13. The tool of claim 12, wherein said rib comprises right and left projections above said tail cover and covering an upper side of brush holding holes formed in said motor housing.

14. The tool of claim 13, wherein said tail cover comprises brush pressers that engage engaging portions of said right and left projections.

15. The tool of claim 11, wherein said projection comprises a plurality of ribs that provide a three-point support.

16. The tool of claim 11, further comprising a downward projection on a lower end of said motor housing.

17. The tool of claim 16, wherein said downward projection projects beyond said tail cover through a hole in said tail cover.

18. The tool of claim 11, wherein said projection includes a linear portion that is substantially perpendicular to the axis of said motor.

19. The tool of claim 18, wherein said tail cover comprises a resin material.

20. A percussion tool comprising:

a motor;

a tool holder which detachably holds a tool bit;

a member which converts a turning force of said motor into a reciprocating force, and transmits the reciprocating force to said tool bit, in which an axial direction of said motor is substantially perpendicular to an axial direction of said tool bit which is held by said tool holder;

a motor housing which covers said motor, comprising a hard material; and a tail cover attached to a lower end of said motor housing, wherein a projection, which projects beyond said tail cover, is integrally-formed with said motor housing, and wherein said motor housing comprises a bearing bracket, said projection being in said bearing bracket.

21. A percussion tool comprising:

a motor;

a tool holder which detachably holds a tool bit;

a member which converts a turning force of said motor into a reciprocating force, and transmits the reciprocating force to said tool bit, in which an axial direction of said motor is substantially perpendicular to an axial direction of said tool bit which is held by said tool holder;

a motor housing which covers said motor, comprising a hard material; and a tail cover attached to a lower end of said motor housing, wherein a projection, which projects beyond said tail cover, is integrally-formed with said motor housing, and wherein said projection comprises at least one of:

a rib between said tool holder and said tail cover, and a projection over a bearing bracket of said motor housing.

* * * * *